US010669665B2

(12) United States Patent
Cheon et al.

(10) Patent No.: US 10,669,665 B2
(45) Date of Patent: Jun. 2, 2020

(54) WASHING MACHINE HAVING MULTIPLE WASHING UNITS

(71) Applicant: SAMSUNG ELECTRONICS CO., LTD., Suwon-si, Gyeonggi-do (KR)

(72) Inventors: Young-Seong Cheon, Suwon-si (KR); Seung-Mok Lee, Suwon-si (KR)

(73) Assignee: SAMSUNG ELECTRONICS CO., LTD, Suwon-si (KR)

( * ) Notice: Subject to any disclaimer, the term of this patent is extended or adjusted under 35 U.S.C. 154(b) by 134 days.

(21) Appl. No.: 15/852,882

(22) Filed: Dec. 22, 2017

(65) Prior Publication Data

US 2018/0179690 A1 Jun. 28, 2018

(30) Foreign Application Priority Data

Dec. 23, 2016 (KR) ..... 10-2016-0178545

(51) Int. Cl.

| | |
|---|---|
| ***D06F 29/00*** | (2006.01) |
| ***D06F 39/02*** | (2006.01) |
| ***D06F 39/14*** | (2006.01) |
| ***D06F 37/18*** | (2006.01) |
| ***D06F 37/06*** | (2006.01) |

(Continued)

(52) U.S. Cl.

CPC ..... *D06F 39/028* (2013.01); *D06F 17/06* (2013.01); *D06F 29/00* (2013.01); *D06F 37/06* (2013.01); *D06F 37/18* (2013.01); *D06F 37/22* (2013.01); *D06F 37/266* (2013.01); *D06F 37/40* (2013.01); *D06F 39/005* (2013.01); *D06F 39/02* (2013.01); *D06F 39/04* (2013.01); *D06F 39/085* (2013.01); *D06F 39/088* (2013.01); *D06F 39/14* (2013.01); *D06F 2222/00* (2013.01)

(58) Field of Classification Search

CPC ..... D06F 29/00; D06F 39/02; D06F 39/088
See application file for complete search history.

(56) References Cited

U.S. PATENT DOCUMENTS

2015/0143857 A1* 5/2015 Jo ..... D06F 39/02 68/17 R
2015/0211164 A1* 7/2015 Kim ..... D06F 39/14 68/133

(Continued)

FOREIGN PATENT DOCUMENTS

CN 104404736 A * 3/2015 ..... D06F 29/02
JP 2016-105833 6/2016

(Continued)

OTHER PUBLICATIONS

Machine English translation of Description of JP 2016105833 A (Tatsunari et al., Jun. 2016) (Year: 2016).*

(Continued)

*Primary Examiner* — Joseph L. Perrin
*Assistant Examiner* — Irina Graf
(74) *Attorney, Agent, or Firm* — Staas & Halsey LLP

(57) ABSTRACT

A washing machine includes a first housing, a second housing arranged above the first housing and having a laundry inlet arranged on the top, a first tub covered by the first housing and having a first opening on the front, a second tub covered by the second housing and having a second opening on the top, and a detergent container arranged in the second housing for storing a detergent to be supplied to the first tub.

15 Claims, 10 Drawing Sheets

(51) Int. Cl.

| | |
|---|---|
| ***D06F 37/22*** | (2006.01) |
| ***D06F 39/04*** | (2006.01) |
| ***D06F 39/08*** | (2006.01) |
| ***D06F 17/06*** | (2006.01) |
| ***D06F 37/40*** | (2006.01) |
| ***D06F 39/00*** | (2020.01) |
| ***D06F 37/26*** | (2006.01) |

(56) References Cited

U.S. PATENT DOCUMENTS

| | | | | |
|---|---|---|---|---|
| 2016/0194808 | A1 | 7/2016 | Jo et al. | |
| 2016/0194814 | A1 | 7/2016 | Kim et al. | |
| 2017/0159223 | A1* | 6/2017 | Alexander | D06F 39/083 |

FOREIGN PATENT DOCUMENTS

| | | |
|---|---|---|
| KR | 10-1306723 | 9/2013 |
| KR | 10-2015-0061824 | 6/2015 |
| KR | 10-2015-0072169 | 6/2015 |
| KR | 10-2015-0146135 | 12/2015 |

OTHER PUBLICATIONS

International Search Report dated Apr. 11, 2018, in corresponding International Patent Application No. PCT/KR2017/014718, 3 pgs.
European Search Report dated Sep. 9, 2019 in related European Patent Application No. 17885239.8.

* cited by examiner

WASHING MACHINE HAVING MULTIPLE WASHING UNITS

CROSS-REFERENCE TO RELATED APPLICATION

This application claims priority to and the benefit of a Korean Patent Application No. 10-2016-0178545 filed on Dec. 23, 2016, the disclosures of which is incorporated herein by reference in its entirety.

BACKGROUND

1. Field of the Invention

The present disclosure relates to a washing machine, and more particularly, to a washing machine with a plurality of washing units.

2. Discussion of Related Art

Washing machines are devices for doing laundry by rotating its cylindrical drum that contains laundry. As for types of the washing machine, there are washers in which a drum is substantially horizontally positioned to do laundry by raising and dropping the laundry along the inner wall of the drum while rotating around the horizontal axis, and washers in which a drum having a pulsator therein is substantially vertically positioned to do laundry using water currents produced by the pulsator while the drum is rotating around the vertical axis.

The washer in which the drum is horizontally positioned is called a front loading washer because a laundry inlet is formed on the front, and the washer in which the drum is vertically positioned is called a top loading washer because a laundry inlet is formed on the top.

Conventional washing machines have a single washing unit, so if the user wants to wash separate clothes, the user is bothered to drive the washing machine more than twice. In this case, the user has to drive the washing machine for many hours even if the amount of clothes is relatively small.

SUMMARY OF THE INVENTION

An aspect of the present disclosure is to provide a washing machine with a plurality of washing units.

Another aspect of the present disclosure is to provide a washing machine that may facilitate easy supply of a detergent to a tub located in a lower portion.

Another aspect of the present disclosure is to provide a washing machine capable of preventing a detergent and a fabric softener or a beaching agent from being mixed and added in together.

Another aspect of the present disclosure is to provide a washing machine capable of easy detachment or attachment of a container cover from or to a housing.

Another aspect of the present disclosure is to provide a washing machine having a top door that may be opened while a container cover closes the detergent container.

In accordance with one aspect to the present disclosure, a washing machine includes a first housing, a second housing arranged above the first housing and having a laundry inlet arranged on the top, a first tub covered by the first housing and having a first opening on the front, a second tub covered by the second housing and having a second opening on the top, and a detergent container arranged in the second housing for storing a detergent to be supplied to the first tub.

The detergent container may include a first detergent container arranged at one end of a front side of the second housing, and a second detergent container arranged at the other end opposite to the one end of the front side of the second housing.

The washing machine may further include a detergent supply hose configured to guide detergents stored in the first and second detergent containers to the first tub arranged in the first housing, wherein the detergent supply hose may be configured for a first inflow tube connected to the first detergent container and a second inflow tube connected to the second detergent container to join on top of the first tub.

The first or second detergent containers may be configured to receive water from a water supply source and supply detergents to the first tub arranged in the first housing.

The detergent container may include a third detergent container arranged adjacent to the second detergent container.

The washing machine may further include a container cover coupled to one side of the laundry inlet of the second housing and covered the detergent container.

The container cover may be arranged ahead of the laundry inlet.

The container cover comprises a first recess formed at a top end toward the laundry inlet.

The washing machine may further include a door coupled to the second housing for opening or closing the laundry inlet, wherein the first recess may be formed to be recessed in a direction away from the door.

The washing machine may further include a pivot shaft member configured to pivotally support the container cover against the second housing, wherein the pivot shaft member may be configured to be drawn into the container cover or drawn out of the container cover.

The container cover may include an elastic member configured to press the pivot shaft member outwards from the container cover.

The container cover may include a lever hole, and wherein the pivot shaft member may include a lever slidably inserted into the lever hole and protruding outside the container cover.

The container cover may include a guide bracket configured to guide movement of the pivot shaft member.

The container cover may include a buffering member arranged on the bottom of one side opposite to the other side where the pivot shaft member of the container cover is arranged.

The second housing may include a second recess formed in a portion facing a side opposite to the other side where the pivot shaft member of the container cover is arranged.

In accordance with another aspect of the present disclosure, a washing machine includes a first housing, a second housing arranged above the first housing and having a laundry inlet, a first tub covered by the first housing, a second tub covered by the second housing, a first detergent container arranged at an end of one side of the front width of the laundry inlet for storing a detergent to be supplied to the first tub, a second detergent container arranged at an end of the other side opposite to the end of the one side of the front width of the laundry inlet for storing a detergent to be supplied to the first tub, a container cover arranged ahead of the laundry inlet for opening or closing the first and second detergent containers, and a detergent supply hose configured to guide detergents stored in the first and second detergent containers to the first tub, wherein the detergent supply hose is configured for a first inflow tube connected to the first detergent container and a second inflow tube connected to the second detergent container to join together to be connected to the first tub.

The container cover may include a first recess formed on the rear top of the container cover.

The washing machine may further include a pivot shaft member configured to pivotally support the container cover against the second housing, wherein the pivot shaft member may be configured to be drawn into the container cover or drawn out of the container cover.

In accordance with still another aspect of the present disclosure, a washing machine includes a first housing, a second housing arranged above the first housing and having a laundry inlet, a first tub covered by the first housing, a second tub covered by the second housing, a detergent container arranged ahead of the laundry inlet for storing a detergent to be supplied to the first tub, and a container cover is configured to open or close the detergent container and have a recess formed at a top end toward the laundry inlet.

The washing machine may further include a pivot shaft member configured to pivotally support the container cover against the second housing, wherein the pivot shaft member may be configured to be drawn into the container cover or drawn out of the container cover.

BRIEF DESCRIPTION OF THE DRAWINGS

The above and other objects, features and advantages of the present disclosure will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
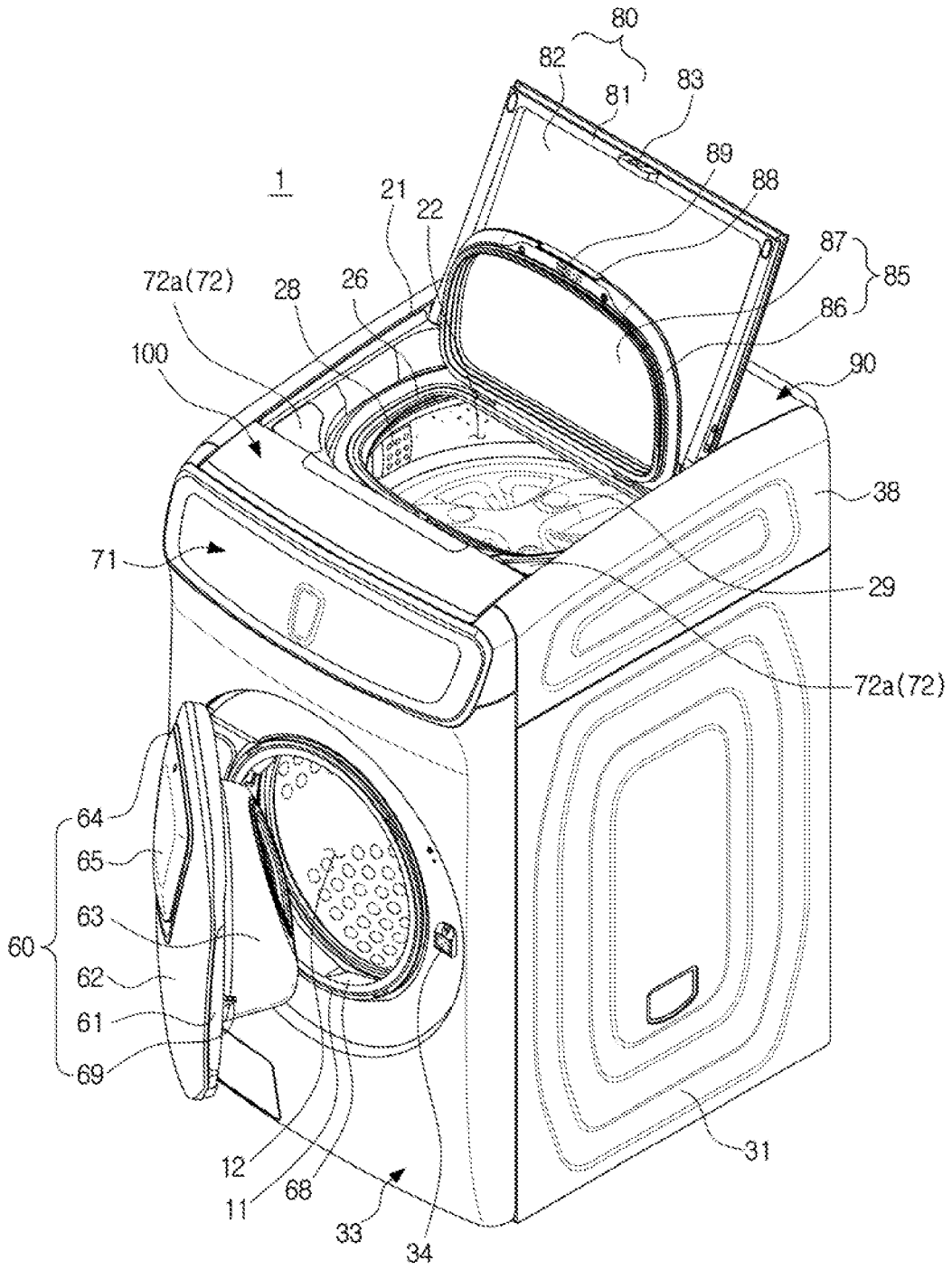
FIG. 1 is a perspective view of a washing machine, according to an embodiment of the present disclosure.

Embodiments and features as described and illustrated in the present disclosure are only preferred examples, and various modifications thereof may also fall within the scope of the disclosure.

Throughout the drawings, like reference numerals refer to like parts or components.

The terminology used herein is for the purpose of describing particular embodiments only and is not intended to limit the present disclosure. It is to be understood that the singular forms "a," "an," and "the" include plural references unless the context clearly dictates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or section discussed below could be termed a second element, component, region, layer or section without departing from the teachings of the present disclosure. Descriptions shall be understood as to include any and all combinations of one or more of the associated listed items when the items are described by using the conjunctive term "~ and/or ~," or the like.

The terms "front", "rear", "upper", "lower", "top", and "bottom" as herein used are defined with respect to the drawings, but the terms may not restrict the shape and position of the respective components.

Reference will now be made in detail to embodiments, examples of which are illustrated in the accompanying drawings, wherein like reference numerals refer to the like elements throughout.

Figure 2:
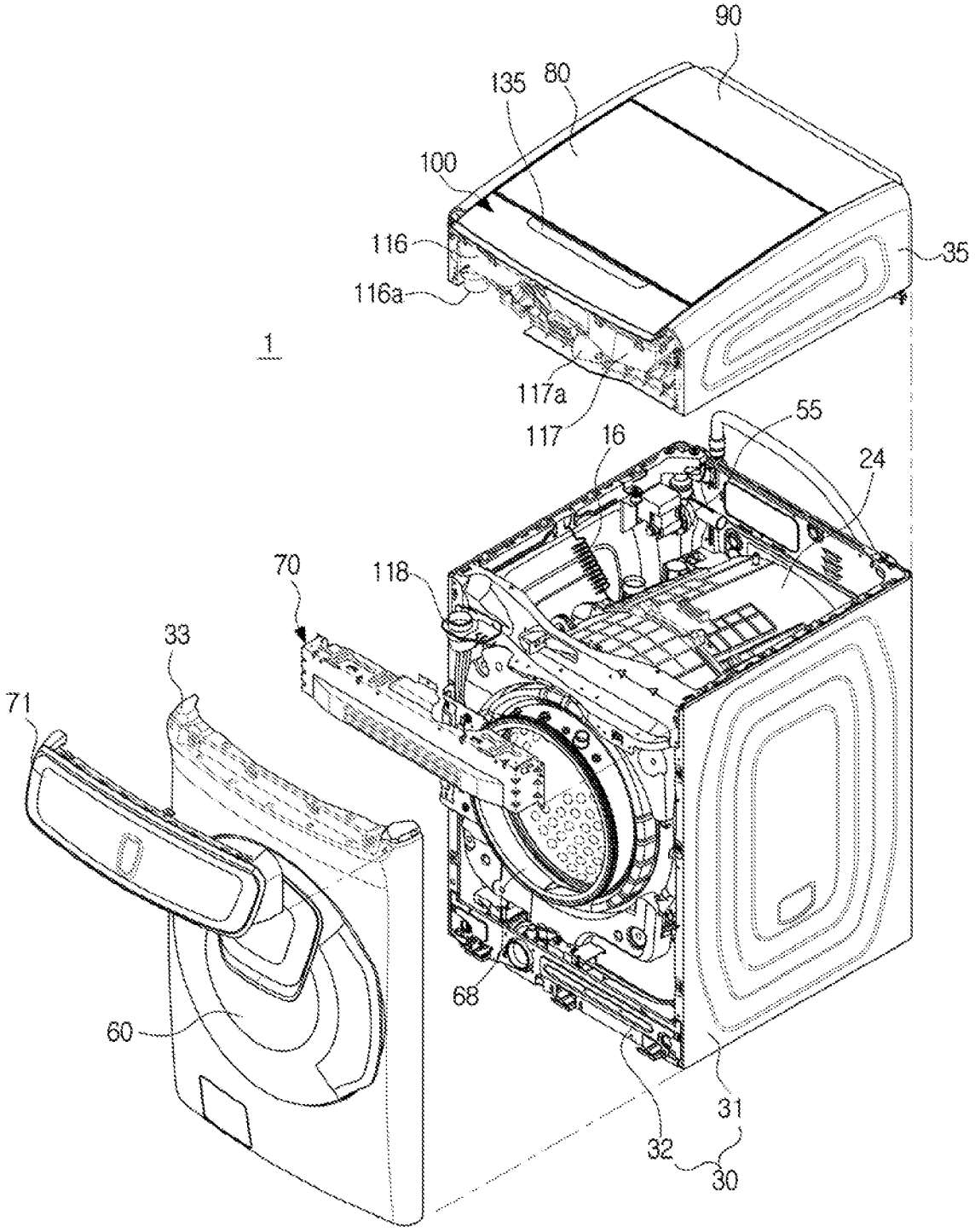
FIG. 2 shows the washing machine shown in FIG. 1 with some parts separated therefrom.
Figure 3:
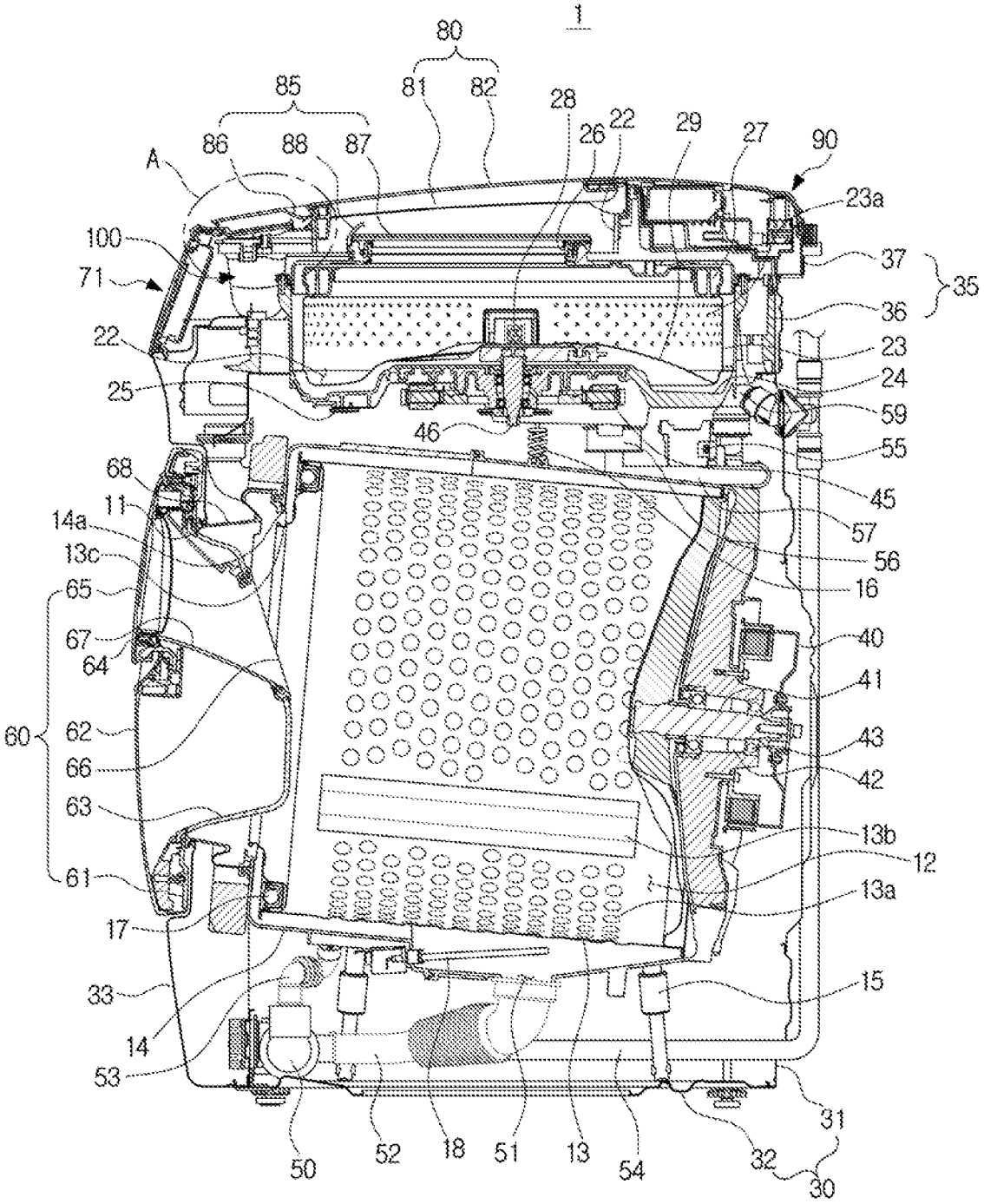
FIG. 3 is a cross-sectional view of the washing machine shown in FIG. 1.

FIG. 1 is a perspective view of a washing machine 1, according to an embodiment of the present disclosure. FIG. 2 shows the washing machine 1 shown in FIG. 1 with some parts separated therefrom. FIG. 3 is a cross-sectional view of the washing machine 1 shown in FIG. 1.

Referring to FIGS. 1 to 3, the washing machine 1 may include a first washing unit of a front-loading type with a first laundry inlet 11 formed on the front, and a second washing unit of a top-loading type with a second laundry inlet 21 formed on the top.

The washing machine 1 may include a first drum 13 in which a first washing space 12 is formed and a first tub 14 containing the first drum 13 and storing water for washing or rinsing to be used in a washing course or a rinsing course. The first drum 13 and the first tub 14 may be shaped like a cylinder with at least a portion of a plane opened, and the open portion may be positioned toward almost the front. The first tub 14 may include a first opening 14*a* formed toward almost the front.

The washing machine 1 may include a first housing 30 covering the first drum 13 and the first tub 14. Specifically, the first housing 30 may include a side frame 31 forming the side and rear exterior, and a bottom frame 32 forming the bottom plane.

Furthermore, the washing machine 1 may include a damper 15 and a spring 16 to support the first tub 14 against the first housing 30. The damper 15 may support the first tub 14 from below by connecting the outer side of the first tub 14 and the bottom frame 32, and the spring 16 may support the first tub 14 from above by connecting the outer side of the first tub 14 and the top end of the side frame 31. The damper 15 and the spring 16 may relieve vibration, noise, and shock caused by a motion of the first tub 14.

Where to install the damper 15 and the spring 16 is not limited to the top end of the side frame 31 and the bottom frame 32, but may be anywhere to support the first tub 14 by connecting a side of the first tub 14 and a portion of the first housing 30 as needed.

The washing machine 1 may include a first driving motor 40 arranged behind the first tub 14 to rotate the first drum 13. A first driving shaft 41 may be coupled to the back of the first drum 13 for delivering power from the first driving motor 40.

A lot of first through holes 13*a* may be formed in the circumference of the first drum 13 for water circulation. On the inside circumference of the first drum 13, a plurality of lifters 13*b* may be provided to enable the laundry to be raised and fallen while the first drum 13 is rotating. A first balancer 17 may be equipped on a front portion of the first drum 13 to help the first drum 13 stably spin at high speed.

The first driving shaft 41 may be arranged between the first drum 13 and the first driving motor 40. One end of the first driving shaft 41 may be coupled to the back plate of the first drum 13, and the other end of the first driving shaft 41 may extend to the outside of the back wall of the first tub 14. When the first driving motor 40 drives the first driving shaft 41, the first drum 13 coupled to the first driving shaft 41 rotates around the first driving shaft 41.

On the back wall of the first tub 14, a bearing housing 42 may be provided to rotationally support the first driving shaft 41. The bearing housing 42 may be made of an aluminum alloy and may be inserted to the back wall of the first tub 14 during injection molding of the first tub 14. Bearings 43 may be provided between the bearing housing 42 and the first driving shaft 41 to enable smooth rotation of the first driving shaft 41.

The washing machine 1 may include a function of doing laundry with hot water. To obtain hot water, a heater 18 may be arranged on the bottom of the first tub 14 to heat the water for washing or rinsing stored in the first tub 14.

The washing machine 1 may include a first drain pump 50 arranged under the first tub 14 for draining the water out of the washing machine 1 from inside the first tub 14, a first coupling hose 52 connecting a first drain 51 of the first tub 14 and the first drain pump 50 for allowing the water inside the first tub 14 to flow into the first drain pump 50, a circulation hose 53 connecting the first drain pump 50 and the first tub 14 for circulating the water flowing into the first drain pump 50 to the first tub 14, and a first drain hose 54 for guiding the water pumped by the first drain pump 50 to the outside of the washing machine 1.

The washing machine 1 may include a front cover 33 with the first laundry inlet 11 through which clothes may be thrown into the first washing space 12. A first door 60 may be combined with the front cover 33 for opening or closing the first laundry inlet 11.

The first door 60 may be arranged to correspond to the first laundry inlet 11 and to be able to pivot on the front cover 33. The first door 60 may include a first door frame 61, a first door cover 62, and a door glass 63.

Although the first door frame 61 is shown to be shaped almost like a round ring in the embodiment of the present disclosure, it may be implemented as being shaped almost like a square ring. The first door cover 62 and the door glass 63 may be implemented to include a transparent material allowing the inside of the first drum 13 to be seen from outside of the washing machine 1 while the first door 60 holds the first laundry inlet 11 shut. The door glass 63 may be formed to be swollen from the first door frame 61 toward the inside of the first drum 13. With this structure, the door glass 63 may be inserted to the inside of the first laundry inlet 11 when the first door 60 is shut.

The first door 60 may include a first hinge coupler formed on one side of the first door frame 61 to be able to pivot on the front cover 33, and the first hinge coupler may be coupled to a first hinge arranged adjacent to the first laundry inlet 11. On the other side of the first door frame 61, a first hook 69 may be provided. A first hook receiver 34 may be provided on the front cover 33 to match the first hook 69, enabling the first door 60 to hold the first laundry inlet 11 shut.

The first door 60 may include an auxiliary laundry inlet 64 and an auxiliary door 65 to open or close the auxiliary laundry inlet 64 in order to throw clothes into the first washing space 12 while the first door 60 is shut. The auxiliary door 65 may be pivotally mounted on the first door cover 62.

To throw the laundry into the washing machine 1 through the auxiliary laundry inlet 64 of the first door 60, the laundry needs to pass through the door glass 63. For this, the door glass 63 may have a glass through hole 66 therein. Alternatively, the door glass 63 may be formed to have the top portion sunken to prevent the door glass 63 from being placed behind the auxiliary laundry inlet 64.

To connect the auxiliary laundry inlet 64 of the first door 60 and the glass through hole 66 of the door glass 63, the first door 60 may include a coupling guide 67. The coupling guide 67 may be formed in the shape of a tube with both ends open and a cavity therein.

Specifically, the coupling guide 67 may be connected to the auxiliary laundry inlet 64 at one end and to the glass through hole 66 at the other end. In the embodiment, the coupling guide 67 may be arranged to incline downward from front to back. In other words, the one end of the coupling guide 67 connected to the auxiliary laundry inlet 64 may be at a higher level than the other end. With this configuration, the user may be able to easily throw the laundry into the first drum 13 through the auxiliary laundry inlet 64.

Although the auxiliary door 65 is arranged on the first door 60 in this embodiment, it is not limited thereto and the first door 60 may be provided without the auxiliary laundry inlet 64, the auxiliary door 65, and the coupling guide 67.

The washing machine 1 may include a diaphragm 68 arranged between the first laundry inlet 11 of the front cover 33 and the first opening 14*a* of the first tub 14. The diaphragm 68 may create a passage from the first laundry inlet 11 to a third opening 13*c* of the first drum 13, to reduce vibration transferred to the front cover 33 while the first drum 13 is rotating. A portion of the diaphragm 68 may be located between the first door 60 and the front cover 33 to prevent the water in the first tub 14 from leaking out of the washing machine 1.

The washing machine 1 may include a second drum 23 in which a second washing space 22 is formed and a second tub 24 containing the second drum 23 and storing water for washing or rinsing to be used in a washing course or a rinsing course. The second drum 23 and the second tub 24 may be shaped like a cylinder with at least a portion of a plane open, and the open portion may be positioned toward almost the top. The second tub 24 may include a second opening 26 formed toward almost the top.

The washing machine 1 may include a second housing 35 to cover the second drum 23 and the second tub 24. Specifically, the second housing 35 may include a lower frame 36 to support the second tub 24 and an upper frame 37 equipped with the second laundry inlet 21 through which clothes may be thrown in and settled in an upper portion of the lower frame 36.

A side cover 38 may cover the left and right sides of the lower frame 36 and the upper frame 37 with a single member, thereby simplifying the sides of the second housing 35 and preventing random falling of the lower frame 36 and the upper frame 37 when they are dismounted from vibration or something and thus from hurting the user.

The washing machine 1 may include a second door 80 equipped in the second housing 35 for opening or closing the second laundry inlet 21. The second door 80 may be arranged to correspond to the second laundry inlet 21 and to be able to pivot on the upper frame 37.

The second door 80 may include a second door frame 81 and a second door cover 82. The second door cover 82 may be implemented to include a transparent material allowing the inside of the second tub 24 and the second drum 23 to be seen from outside of the washing machine 1 while the second door 80 closes the second laundry inlet 21.

Second hinges (not shown) may be provided on the left and right sides of the second door frame 81 for the second door 80 to be able to pivot on the upper frame 37. The second hinge may be coupled to a second hinge coupler (not shown) arranged around the second laundry inlet 21. A latch container 83 may be provided on the front of the second door frame 81, and a latch may be provided on the upper frame 82 to match the latch container 83 of the second door frame 81. With this configuration, the second door 80 of the washing machine 1 in accordance with the embodiment of the present disclosure may hold the second laundry inlet 21 shut.

The second drum 23 may have a cylindrical form with the top open and may be arranged to be able to rotate within the second tub 24. A lot of second through holes 23*a* may be formed in the side and/or bottom plane of the second drum 23 for water circulation. A second balancer 27 may be equipped in an upper portion of the second drum 23 to help the second drum 23 stably spin at high speed. A filter 28 may be attached onto an inner side of the second drum 23 to filter out some foreign materials coming out during washing.

There may be a curved portion 29 formed on the bottom of the second drum 23 for creating water currents. Although not shown, the washing machine 1 may further include a pulsator arranged inside the second drum 23 to produce water currents.

The second tub 24 may have a cylindrical form and may be supported by the lower frame 36 according to a suspension 25. Specifically, the second tub 24 may be supported in a form of hanging to the lower frame 36 by four of the suspensions 25. The second opening 26 may be formed on the top of the second tub 23 to correspond to the second laundry inlet 21, and may be coupled with a third door 85 to open or close the second opening 26. The third door 85 may seal the second washing space 22 to prevent leakage of wet steam if the second washing unit performs a washing course with hot water.

The third door 85 may include a third door frame 86 and a third door cover 87. The third door cover 87 may be implemented to include a transparent material allowing the inside of the second drum 23 to be seen from outside of the second tub 24 while the third door 85 closes the second opening 26.

A third hinge (not shown) may be arranged in a portion of the second tub 24 adjacent to the second opening 26 for the third door 85 to be able to pivot on the second tub 24, and may be coupled with a third hinge coupler (not shown) arranged on a side of the third door frame 86. A handle 88 may be provided on the other side of the third door frame 86 to open the third door 85 and may be equipped with a second hook 89. A second hook container (not shown) may be arranged on the second tub 24 to match the second hook 89, enabling the third door 85 to hold the second opening 26 shut. Furthermore, when the handle 88 is pulled, the second hook 89 falls out of the second hook container, enabling the third door 85 to fully open the second washing space 22.

The washing machine 1 may include a second driving motor 45 arranged under the second tub 24 to rotate the second drum 23. A second driving shaft 46 may be coupled to the bottom of the second drum 23 for delivering power from the second driving motor 45. One end of the second driving shaft 46 may be coupled to the bottom plate of the second drum 23, and the other end of the second driving shaft 46 may extend to the outside of the bottom wall of the second tub 24. When the second driving motor 45 drives the second driving shaft 46, the second drum 23 coupled to the second driving shaft 46 rotates around the second driving shaft 46.

Although not shown, if the pulsator is arranged on the bottom of the second drum 23, the washing machine 1 may further include a power switching unit to deliver the driving force produced by the second driving motor 45 to the second drum 23 and the pulsator simultaneously or selectively.

The washing machine 1 may include a second drain pump 55 arranged under the second tub 24 for draining the water stored in the second tub 24 to the outside of the washing machine 1, and a second drain hose 59 for guiding the water pumped by the second drain pump 55 to the outside of the washing machine 1. The second drain pump 55 may be installed above the first housing 30.

A second drain 56 may be arranged on the bottom of the second tub 24 for draining the water from the second tub 24, and the second drain 56 and the second drain pump 55 may be connected by a second coupling hose 57, allowing the water from the second tub 24 to flow into the second drain pump 55.

The washing machine 1 may include a water supplier 90 for supplying laundry water to the first and second tubs 14 and 24. The water supplier 90 may be arranged in the second housing 35. Specifically, the water supplier 90 may be arranged on the upper frame 37 and preferably, behind the second laundry inlet 21.

The washing machine 1 may also include a first detergent supplier 100 for supplying a detergent into the first tub 14. The first detergent supplier 100 may be arranged in the second housing 35. Specifically, the first detergent supplier 100 may be arranged on the upper frame 37 and preferably, ahead of the second laundry inlet 21. The first detergent supplier 100 will be described in detail later.

The washing machine 1 may include a second detergent supplier 72 arranged in the second housing 35 for containing a fabric softener and/or a bleaching agent to be supplied into the second washing space 22. The second detergent supplier 72 may be arranged on the upper frame 37 and may have a detergent container 72*a* with an inlet facing almost upward. The second detergent supplier 72 may be arranged on each of the left and right sides ahead of the second opening 26. The second detergent supplier 72 may be configured for the user to access it as the second door 80 is opened.

The washing machine 1 may include a fixing bracket 70 to securely combine the first and second housings 30 and 35.

The washing machine 1 may include a control panel 71 arranged above the front cover 33 for controlling the washing machine 1. The control panel 71 may include an input (not shown) for receiving operation commands for the washing machine 1 from the user, and a display (not shown) for displaying operation information of the washing machine 1.

Figure 4:
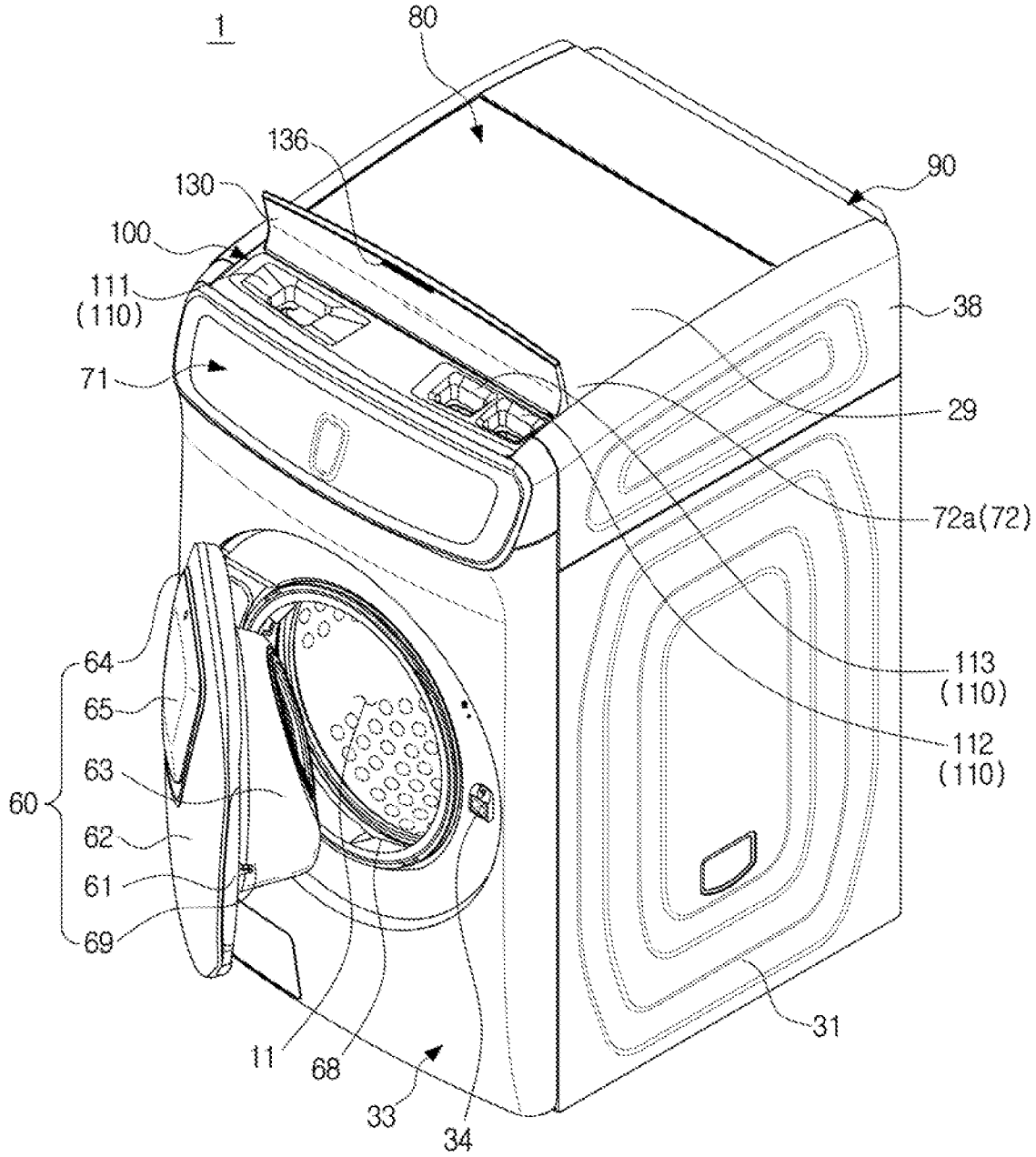
FIG. 4 shows an opened container cover of a first detergent supplier shown in FIG. 1.
Figure 5:
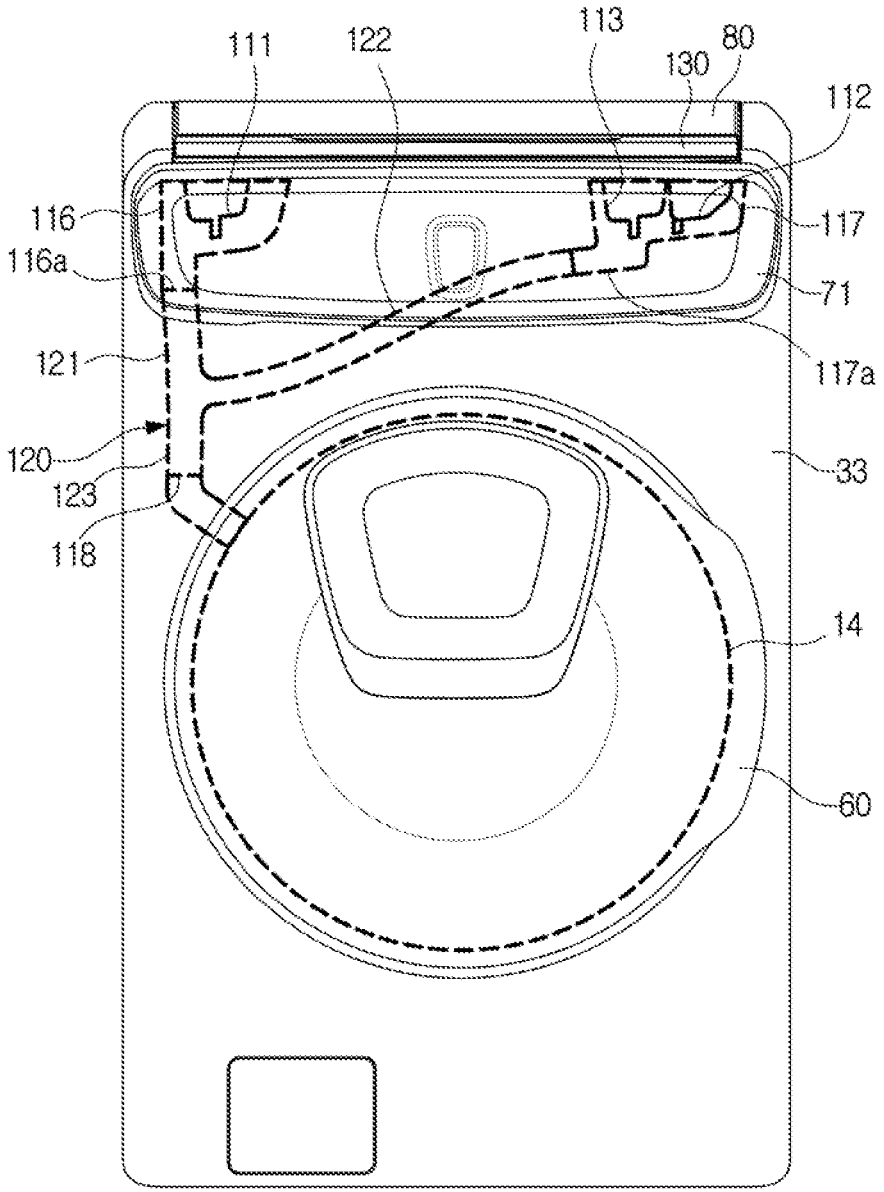
FIG. 5 is a front view of the washing machine shown in FIG. 1 illustrating a path to supply a detergent from the first detergent supplier to a first tub.
Figure 6:
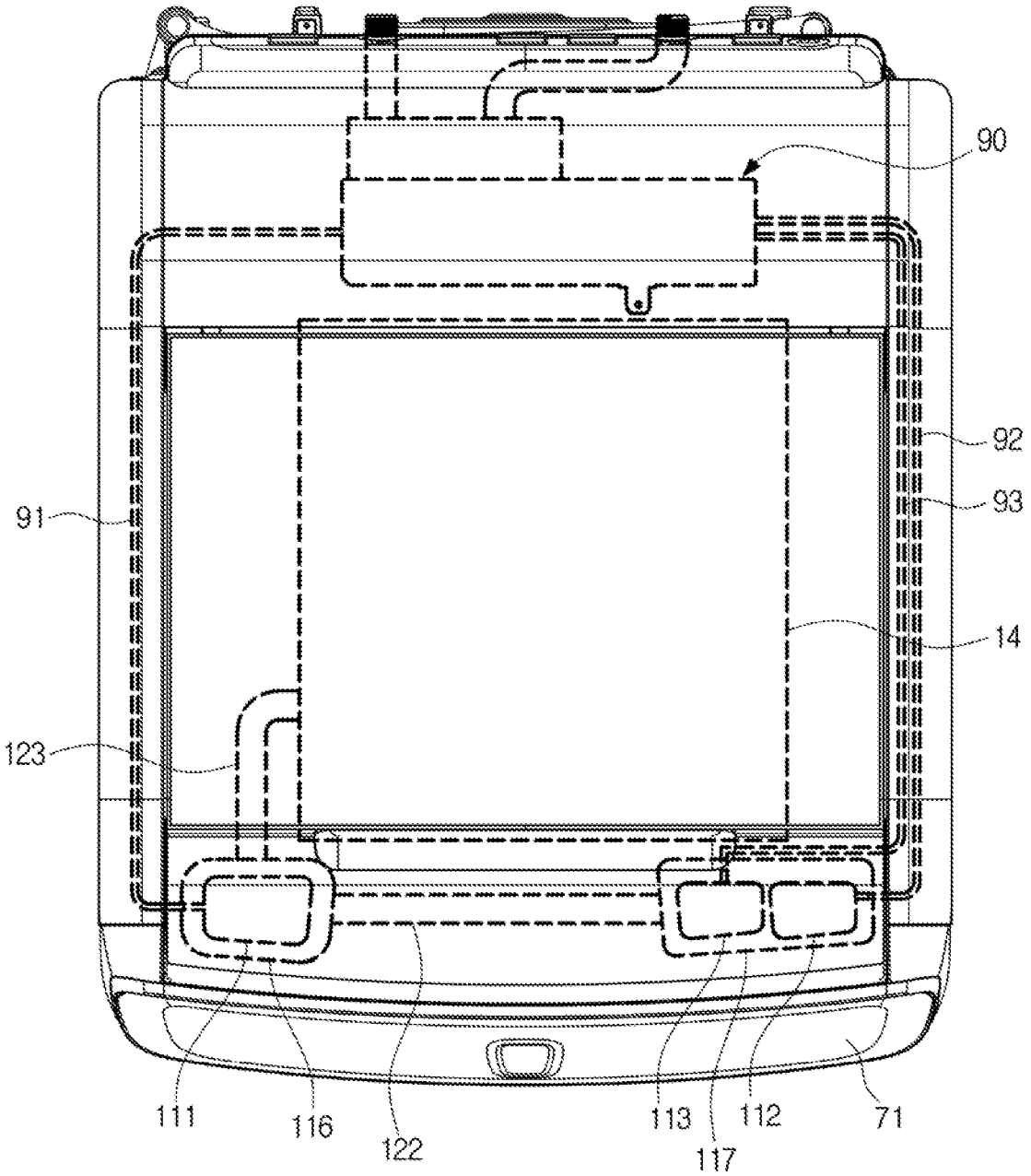
FIG. 6 is a top view of the washing machine shown in FIG. 1 illustrating coupling relations between a water supply, the first detergent supplier, and the first tub.

FIG. 4 shows an opened container cover 130 of the first detergent supplier 100 shown in FIG. 1. FIG. 5 is a front view of the washing machine 1 shown in FIG. 1 illustrating a path to supply a detergent from the first detergent supplier 100 to the first tub 14. FIG. 6 is a top view of the washing machine 1 shown in FIG. 1 illustrating coupling relations between the water supply 90, the first detergent supplier 100, and the first tub 14.

Referring to FIGS. 4 to 6, the first detergent supplier 100 of the washing machine 1 in accordance with the embodiment of the present disclosure may include a detergent container 110 arranged in the second housing 35 for storing a detergent to be supplied into the first tub 14. The detergent as herein used may include a laundry detergent, a fabric softener, and a bleaching agent.

The detergent container 110 may include a first detergent container 111 arranged on one end of the second housing 35 and a second detergent container 112 arranged on the other end of the second housing 35 opposite the one end along the width direction of the second housing 35. Specifically, the first detergent container 111 may be arranged at the left end ahead of the second laundry inlet 21 and the second detergent container 112 may be arranged at the right end ahead of the second laundry inlet 21.

While a laundry detergent may be stored in the first detergent container 111, and a fabric softener or a bleaching agent may be stored in the second detergent container 112 in the washing machine 1 of the embodiment of the present disclosure, the present disclosure is not limited thereto.

Moreover, the washing machine 1 may include a third detergent container 113 arranged adjacent to the second detergent container 112. The third detergent container 113 may be configured to store a different detergent from those stored in the first and second detergent containers 111 and 112. For example, the first detergent container 111 may contain a laundry detergent, the second detergent container 112 may contain a bleaching agent, and the third detergent container 113 may contain a fabric softener, without being limited thereto.

Referring to FIG. 2, the first detergent container 111 may be covered by and linked to a first detergent container cover 116. The first detergent container cover 116 may include a first connection tube 116*a* connected to a first inflow tube 121 of a detergent supply hose 120, which will be described later.

The second detergent container 112 may be covered by and linked to a second detergent container cover 117. The second detergent container cover 117 may include a second connection tube 117*a* connected to a second inflow tube 122 of the detergent supply hose 120, which will be described later.

The first tub 14 may include a third connection tube 118 connected to an outflow tube 123 of the detergent supply hose 120. The third connection tube 118 may guide the laundry water and/or a detergent to the first tub 14 through the outflow tube 123.

Referring to FIG. 5, the first detergent supplier 100 may include the detergent supply hose 120 that connects the detergent container 110 and the first tub 14 for guiding the detergent stored in the detergent container 110 to the first tub 14. The detergent supply hose 120 may guide the detergents stored in the first and second detergent containers 111 and 112 to the first tub 14. For this, the detergent supply hose 120 may include the first inflow tube 121 connected to the first detergent container 111, the second inflow tube 122 connected to the second detergent container 112, and the outflow tube 123 connected to the first tub 14. In other words, the detergent supply hose 120 may be connected to the first tub 14 through the outflow tube 123 where the first and second inflow tubes 121 and 122 meet.

In the case that the detergent container 110 includes the third detergent container 113, the third detergent container 113 may be connected to the second inflow tube 122 connected to the second detergent container 112. Accordingly, the third detergent container 113 may be guided to the first tub 14 through the second inflow tube 122 and the outflow tube 123.

Specifically, the first inflow tube 121 may be connected to the first detergent container cover 116 linked to the first detergent container 111, and the second inflow tube 122 may be connected to the second detergent container cover 117 linked to the second detergent container 112 and/or the third detergent container 113. The outflow tube 123 may be connected to the third connection tube 118 connected to the first tub 14.

The detergent supply hose 120 may be configured for the first inflow tube 121, the second inflow tube 122, and the outflow tube 123 to meet further above than the first tub 14. In other words, the detergent supply hose 120 may be configured for the first inflow tube 121 and the second inflow tube 122 to meet further above than the first tub 14.

Referring to FIG. 6, the first detergent container 111 may be connected to the water supplier 90 through the first water supply tube 91. Accordingly, the first detergent container 111 may receive laundry water to be supplied to the first tub 14 from the water supplier 90. The first detergent container 111 may be connected to the first tub 14. Specifically, the first detergent container 111 may be connected to the first tub 14 through the first inflow tube 121 and the outflow tube 123.

With the configurations, the laundry water supplied to the first detergent container 111 may be supplied to the first tub 14 along with the detergent stored in the first detergent container 111. Specifically, the laundry water supplied from the water supplier 90 may move to the first detergent container 111 past the first water supply tube 91 and may be supplied to the first tub 14 past the first inflow tube 121 and the outflow tube 123 along with the detergent from the first detergent container 111.

If the detergent contained in the first detergent container 111 is a laundry detergent or a bleaching agent, the water supplier 90 may supply the laundry water to the first detergent container 111 during a washing course of the washing machine 1, and if the detergent contained in the first detergent container 111 is a fabric softener, the water supplier 90 may supply the laundry water to the first detergent container 111 during a rinsing course of the washing machine 1.

The second detergent container 112 may be connected to the water supplier 90 through the second water supply tube 92. Accordingly, the second detergent container 112 may receive laundry water to be supplied to the first tub 14 from the water supplier 90. The second detergent container 112 may be connected to the first tub 14. Specifically, the second detergent container 112 may be connected to the first tub 14 through the second inflow tube 122 and the outflow tube 123.

With the configurations, the laundry water supplied to the second detergent container 112 may be supplied to the first tub 14 along with the detergent stored in the second detergent container 112. Specifically, the laundry water supplied from the water supplier 90 may move to the second detergent container 112 past the second water supply tube 92 and may be supplied to the first tub 14 past the second inflow tube 122 and the outflow tube 123 along with the detergent from the second detergent container 112.

If the detergent contained in the second detergent container 112 is a laundry detergent or a bleaching agent, the water supplier 90 may supply the laundry water to the second detergent container 112 during a washing course of the washing machine 1, and if the detergent contained in the second detergent container 112 is a fabric softener, the water supplier 90 may supply the laundry water to the second detergent container 112 during a rinsing course of the washing machine 1.

The third detergent container 113 may be connected to the water supplier 90 through the third water supply tube 93. Accordingly, the third detergent container 113 may receive laundry water to be supplied to the first tub 14 from the water supplier 90. The third detergent container 113 may be connected to the first tub 14. Specifically, the third detergent container 113 may be connected to the first tub 14 through the second inflow tube 122 and the outflow tube 123.

With the configurations, the laundry water supplied to the third detergent container 113 may be supplied to the first tub 14 along with the detergent stored in the third detergent container 113. Specifically, the laundry water supplied from the water supplier 90 may move to the third detergent container 113 past the third water supply tube 93 and may be supplied to the first tub 14 past the second inflow tube 122 and the outflow tube 123 along with the detergent from the third detergent container 113.

If the detergent contained in the third detergent container 113 is a laundry detergent or a bleaching agent, the water supplier 90 may supply the laundry water to the third detergent container 113 during a washing course of the washing machine 1, and if the detergent contained in the third detergent container 113 is a fabric softener, the water supplier 90 may supply the laundry water to the third detergent container 113 during a rinsing course of the washing machine 1.

With the configurations, the washing machine 1 in accordance with the embodiment of the present disclosure may allow the user to conveniently provide a detergent to be supplied to the first tub 14 arranged in a lower portion through the first detergent supplier 100 arranged in an upper portion without stooping down.

Furthermore, the washing machine 1 in accordance with the embodiment of the present disclosure may have the first detergent container 111, the second detergent container 112, and the third detergent container 113 arranged separately at the left and right ends of the second laundry inlet 21, thereby preventing the detergent contained in the first detergent container 111 from being mixed with detergents contained in the second detergent container 112 and the third detergent container 113 and thrown in together to the first tub 14.

Moreover, in the washing machine 1 in accordance with the embodiment of the present disclosure, the first inflow tube 121 connected to the first detergent container 111 and the second inflow tube 122 connected to the second detergent container 112 and the third detergent container 113 join together and are then connected to the first tub 14 through the outflow tube 123, thereby minimizing a point where the water leakage is likely to occur as compared with a case that the first inflow tube 121 and the second inflow tube 122 are each connected to the first tub 14.

Figure 7:
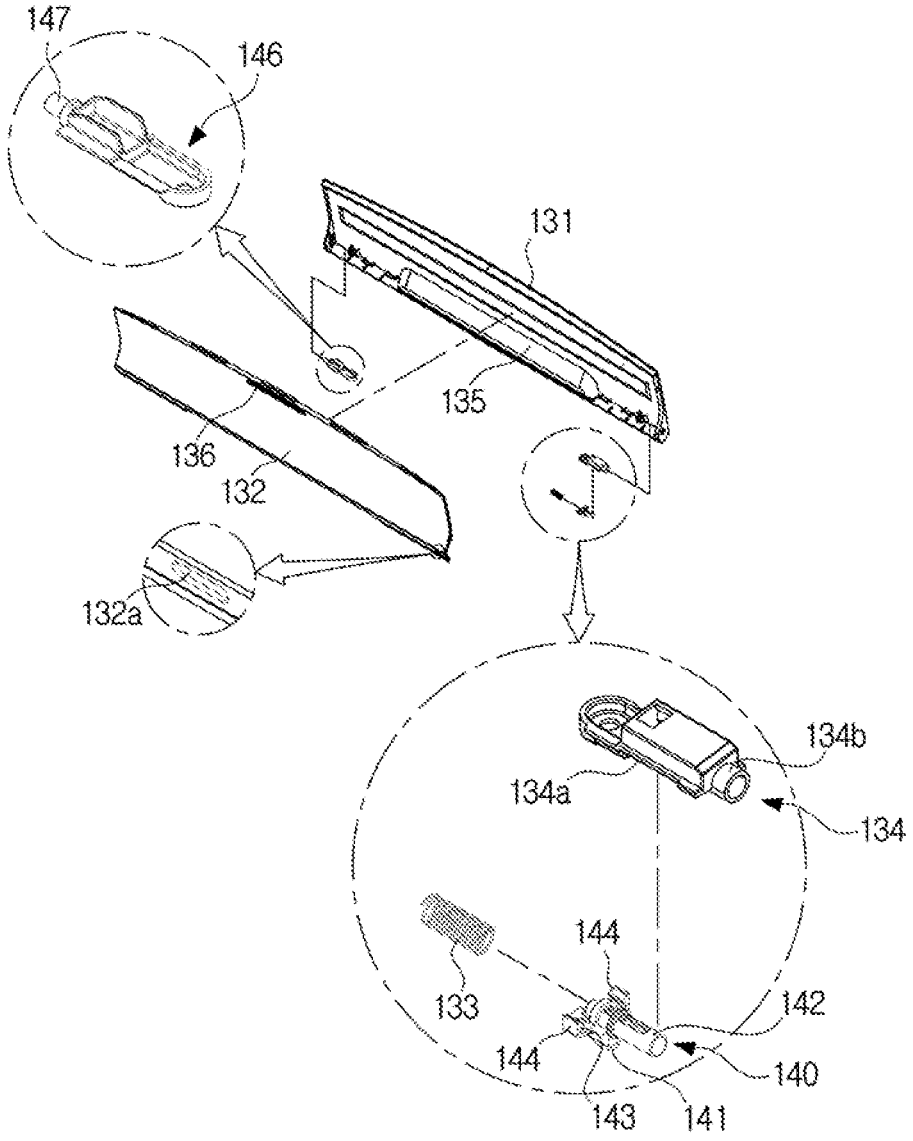
FIG. 7 separately shows the container cover shown in FIG. 4 and a pivot shaft member.
Figure 8:
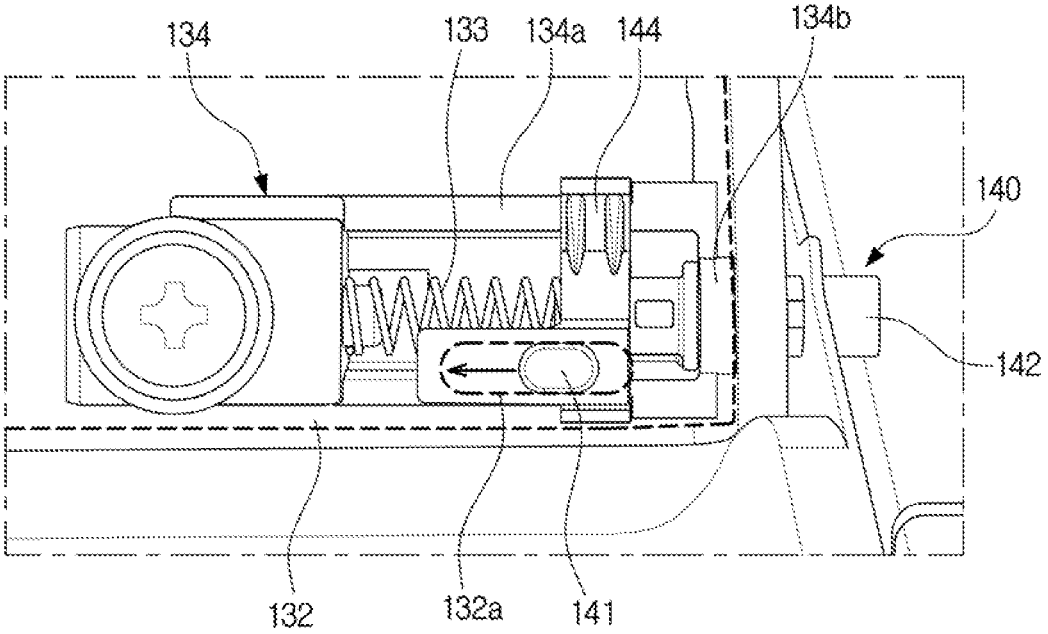
FIG. 8 shows the pivot shaft member supporting the container cover shown in FIG. 4, which is drawn out of the container cover.
Figure 9:
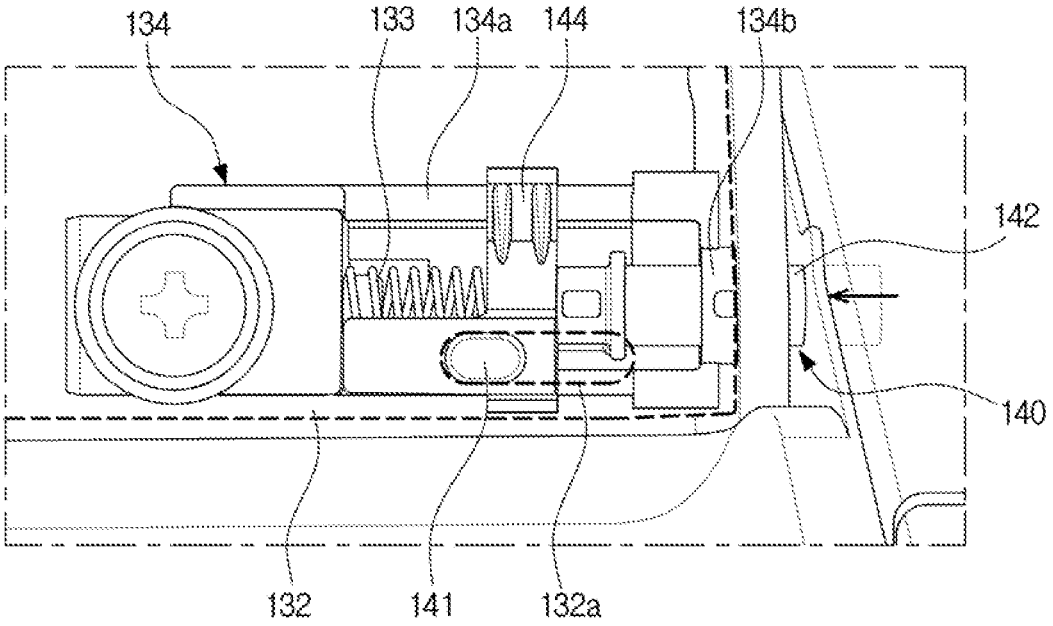
FIG. 9 shows the pivot shaft member of the container cover shown in FIG. 8, which is drawn into the container cover.
Figure 10:
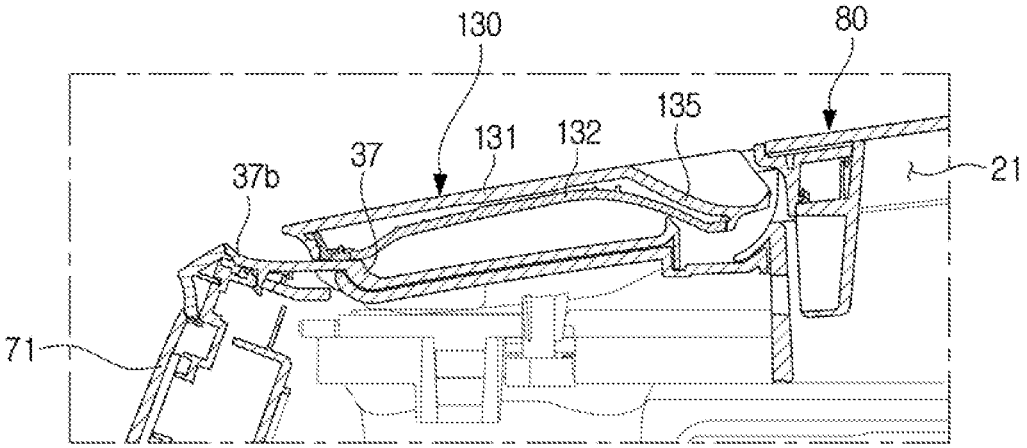
FIG. 10 is an enlarged view of portion 'A' shown in FIG. 3.

FIG. 7 separately shows the container cover 130 shown in FIG. 4 and a pivot shaft member 140. FIG. 8 shows the pivot shaft member 140 supporting the container cover 130 shown in FIG. 4, which is drawn out of the container cover 130. FIG. 9 shows the pivot shaft member 140 of the container cover 130 shown in FIG. 8, which is drawn into the container cover 130. FIG. 10 is an enlarged view of portion 'A' shown in FIG. 3.

Referring to FIGS. 4 and 7, the washing machine 1 in accordance with an embodiment of the present disclosure may include the container cover 130 provided to cover the detergent container 110 and the pivot shaft member 140 for pivotally supporting the container cover 130.

The container cover 130 may be pivotally combined with the upper frame 37. The container cover 130 may be arranged where the detergent container 110 is arranged ahead of the second laundry inlet 21. In other words, the detergent container 110 may be arranged before the second door 80.

The pivot shaft member 140 may be rotationally combined with a combiner (not shown) of the upper frame 37 for pivotally supporting the container cover 130. The pivot shaft member 140 may be configured to be drawn to the inside of the container cover 130 or drawn out of the container cover 130.

Specifically, the container cover 130 may include a first cover 131, a second cover 132, an elastic member 133, and a guide bracket 134.

While the container cover 130 holds the detergent container 110 shut, the first cover 131 may form an upper exterior of the container cover 130 and the second cover 132 may form a lower exterior of the cover 130.

The elastic member 133 may be fixed to a portion on the inner side of the container cover 130 at one end and may be connected to the pivot shaft member 140 at the other end. The elastic member 133 may be provided to press the pivot shaft member 140 outwards from the container cover 130.

The guide bracket 134 may be coupled to the inner side of the first cover 131 or the second cover 132 for guiding the movement of the pivot shaft member 140. The guide bracket 134 may be coupled to the first cover 131 by screwing. One end of the elastic member 133 may be fixed to the guide bracket 134.

The guide bracket 134 may include a guide protrusion **134*a* inserted to a guide recess 143 of the pivot shaft member 140 for supporting the pivot shaft member 140 to be able to slide. The guide bracket 134 may include a shaft hole 134*b* into which an axial shaft 142 of the pivot shaft member 140** may be slidingly inserted.

The pivot shaft member 140 may include a lever 141 to be slidingly inserted to a lever hole **132*a* of the second cover 132. The lever 141 may protrude outwards from the container cover 130 for the user to be able to manipulate the pivot shaft member 140**.

The pivot shaft member 140 may be slidingly inserted to the shaft hole **134*b* of the guide bracket 134 and may include the axial shaft 142 to be inserted to the combiner of the upper frame 37. The axial shaft 142 may be drawn into the inner side of the container cover 130 or may protrude outward from the container cover 130**.

The pivot shaft member 140 may include the guide recess 143 into which the guide protrusion **134*a* of the guide bracket 134 is inserted. The guide recess 143 may be formed on the inner side of a substantially ringed protrusion 144 and may have substantially the same size and shape as the cross-section of the guide protrusion 134*a***.

Referring to FIG. 8, when the container cover 130 is combined with the second housing 35, the axial shaft 142 may be rotationally combined with the combiner of the upper frame 37. In this case, the elastic member 133 may press the pivot shaft member 140 in a direction of being drawn out from the container cover 130. With the configuration, the container cover 130 may remain in the state of being pivotally combined with the second housing 35.

Referring to FIG. 9, if the user intends to separate the container cover 130 from the second housing 35, the user may move the lever 141 to the left to draw in the pivot shaft member 140 to the inner side of the container cover 130. Specifically, if the user lifts the container cover 130 and presses the lever 141 protruding from the bottom to the left, the elastic member 133 contracts and the lever 141 is moved to the left along the lever hole 132*a*. Accordingly, the axial shaft 142 is separated from the combiner of the upper frame 37, and the user may be able to easily separate the container cover 130 from the upper frame 37.

The pivot shaft member 140 as described above may be arranged at the left end and/or right end of the container cover 130. In a case that the pivot shaft member 140 is arranged at one of the left and right ends, a pivot shaft 146 simply fixed to the first cover 131 or the second cover 132 may be arranged at the other end. The pivot shaft 146 may include an axial shaft part 147, which may be rotationally combined with the combiner (not shown) of the upper frame 37.

With the configurations, the washing machine 1 in accordance with an embodiment of the present disclosure may allow the container cover 130 to cover the detergent container 110 to be easily separated from or combined with the second housing 35.

The container cover 130 may include a first recess 135 formed on the top of an end toward the second door 80. The rear end of the top of the container cover 130 may have the first recess 135 sunken down. The first recess 135 may be concavely formed in and second bottom doors 135 and 80 may be pivotally opened or closed in a receding direction from the second door 80.

The user may be able to lift the front end of the second door 80 through the space formed by the first recess 135 between the front end of the second door 80 and the container cover 130. Accordingly, the washing machine 1 may open the second laundry inlet 21 by pivoting the second door 80 even while the container cover 130 holds the detergent container 110 shut.

In a portion of the upper frame 37 that corresponds to the front end of the container cover 130, a second recess 37*b* sunken in a receding direction from the container cover 130 may be formed. In a portion of the upper frame 37 that corresponds to the other end opposite an end at which the pivot shaft member 140 is arranged, the second recess 37*b* sunken in a receding direction from the container cover 130 may be formed.

The user may be able to lift the container cover 130 through the space formed by the second recess 37*b* between the front end of the container cover 130 and the upper frame 37.

The container cover 130 may include a buffering member 136 arranged under the front end of the container cover 130. The buffering member 136 may be implemented to include an elastic material. The buffering member 136 may be arranged on the bottom of the other side opposite the one side where the pivot shaft member 140 of the container cover 130 is arranged. The buffering member 136 may relieve shocks likely to be caused by a collision between the front end of the container cover 130 and the upper frame 37 when the container cover 130 slams the detergent container 110 shut.

According to embodiments of the present disclosure, a washing machine may have a plurality of washing units, enabling clothes to be washed separately as needed.

According to embodiments of the present disclosure, a washing machine may have a detergent container arranged in an upper portion for storing a detergent to be supplied to a tub, thereby allowing the detergent to be easily supplied to the tub located in a lower portion.

According to embodiments of the present disclosure, a washing machine may have a detergent container for storing a laundry detergent and a detergent container for storing a fabric softener or a bleaching agent arranged separately, thereby preventing the laundry detergent and the fabric softener or the bleaching agent from being mixed and added in together.

According to embodiments of the present disclosure, a washing machine may have a pivot shaft member arranged to be drawn into or out of the container cover, thereby enabling the container cover to be easily detached from or attached to the washing machine.

According to embodiments of the present disclosure, a washing machine may have a recess formed in a portion of a container cover directed to a door arranged on the top, thereby enabling the door to be opened while the container cover holds the detergent container shut.

Several embodiments have been described above, but a person of ordinary skill in the art will understand and appreciate that various modifications can be made without departing the scope of the present disclosure. Thus, it will be apparent to those ordinary skilled in the art that the true scope of technical protection is only defined by the following claims.

What is claimed is:

1. A washing machine comprising:

a first housing;

a second housing arranged above the first housing and having a laundry inlet arranged on a top thereof;

a first tub included in the first housing and having a first opening on a front thereof;

a second tub included in the second housing and having a second opening on a top thereof;

a detergent container arranged in an upper part of the second housing to store a detergent to be supplied to the first tub, the detergent container being in front of the laundry inlet;

a door coupled to the second housing to open or close the laundry inlet; and a container cover coupled to the second housing to cover the detergent container, the container cover comprising a first recess recessed from a top surface of the container cover toward the laundry inlet, wherein the first recess is formed in front of a front end of the door so that a user can open or close the door by accessing a space formed by the first recess and the front end.

2. The washing machine of claim 1, wherein the detergent container comprises:

a first detergent container arranged at one end of a front side of the second housing; and a second detergent container arranged at an other end opposite to the one end of the front side of the second housing.

3. The washing machine of claim 2, further comprising:

a detergent supply hose configured to guide detergents stored in the first detergent container and the second detergent container to the first tub arranged in the first housing, wherein the detergent supply hose is configured for a first inflow tube connected to the first detergent container and a second inflow tube connected to the second detergent container to join on top of the first tub.

4. The washing machine of claim 2, wherein one of the first and the second detergent container is configured to receive water from a water supply source and supply detergents to the first tub arranged in the first housing.

5. The washing machine of claim 2, wherein the detergent container comprises a third detergent container arranged adjacent to the second detergent container.

6. The washing machine of claim 1, further comprising a pivot shaft member configured to pivotally support the container cover against the second housing, wherein the pivot shaft member is configured to be drawn into the container cover or drawn out of the container cover.

7. The washing machine of claim 6, wherein the container cover comprises an elastic member configured to press the pivot shaft member outwards from the container cover.

8. The washing machine of claim 6, wherein the container cover comprises a lever hole, and wherein the pivot shaft member comprises a lever slidably inserted into the lever hole and protruding outside the container cover.

9. The washing machine of claim 6, wherein the container cover comprises a guide bracket configured to guide movement of the pivot shaft member.

10. The washing machine of claim 6, wherein the container cover comprises a buffering member arranged under a front end of the container cover which is an opposite end of the container cover where the pivot shaft member of the container cover is arranged.

11. The washing machine of claim 6, wherein the second housing comprises a second recess formed from a upper surface of the second housing towards the laundry inlet which corresponds to an opposite end of the container cover where the pivot shaft member of the container cover is arranged.

12. A washing machine comprising:

a first housing;

a second housing arranged above the first housing and having a laundry inlet arranged on a top thereof;

a first tub included in the first housing;

a second tub included in the second housing and having a second opening on a top thereof;

a first detergent container arranged at an end of one side of a front width of the laundry inlet to store a detergent to be supplied to the first tub;

a second detergent container arranged at an end of an other side opposite to the end of the one side of the front width of the laundry inlet to store a detergent to be supplied to the first tub;

a door coupled to the second housing to open or close the laundry inlet;

a container cover arranged in front of the laundry inlet to open or close the first detergent container and the second detergent container, the container cover comprising a first recess recessed from a top surface of the container cover toward the laundry inlet and the first recess being formed in front of a front end of the door so that a user can open or close the door by accessing a space formed by the first recess and the front end; and a detergent supply hose configured to guide detergents stored in the first detergent container and the second detergent container to the first tub, wherein the detergent supply hose is configured for a first inflow tube connected to the first detergent container and a second inflow tube connected to the second detergent container to join together to be connected to the first tub.

13. The washing machine of claim 12, further comprising a pivot shaft member configured to pivotally support the container cover against the second housing, wherein the pivot shaft member is configured to be drawn into the container cover or drawn out of the container cover.

14. A washing machine comprising:

a first housing;

a second housing arranged above the first housing and having a laundry inlet arranged on a top thereof;

a first tub included in the first housing;

a second tub included in the second housing and having a second opening on a top thereof;

a detergent container arranged in front of the laundry inlet to store a detergent to be supplied to the first tub;

a door coupled to the second housing to open or close the laundry inlet;

a container cover is configured to open or close the detergent container and has a recess recessed from a top surface of the container cover toward the laundry inlet, wherein the recess is formed in front of a front end of the door so that a user can open or close the door by accessing a space formed by the first recess and the front end.

15. The washing machine of claim 14, further comprising a pivot shaft member configured to pivotally support the container cover against the second housing, wherein the pivot shaft member is configured to be drawn into the container cover or drawn out of the container cover.

* * * * *